US005775540A

United States Patent [19]

Greenberg

[11] Patent Number: 5,775,540

[45] Date of Patent: Jul. 7, 1998

[54] COLLAPSIBLE TUBE DISPENSER AID

[76] Inventor: Robert M. Greenberg, 80 N. Division St., St. Johnsville, N.Y. 13452

[21] Appl. No.: 396,982

[22] Filed: Mar. 1, 1995

[51] Int. Cl.[6] ..... B65D 35/28

[52] U.S. Cl. ..... 222/102; 222/105

[58] Field of Search ..... 222/92, 96, 98, 222/102, 105, 106, 181.3, 160

[56] References Cited

U.S. PATENT DOCUMENTS

| | | | |
|---|---|---|---|
| 2,622,768 | 12/1952 | Hatcher | 222/102 |
| 2,678,144 | 5/1954 | Holt | 222/102 |
| 2,717,722 | 9/1955 | Egler | 222/102 |
| 2,722,343 | 11/1955 | Wilt | 222/98 |
| 2,932,431 | 4/1960 | Lipton | 222/98 |
| 4,627,551 | 12/1986 | Kopp | 222/102 |

FOREIGN PATENT DOCUMENTS

| | | | |
|---|---|---|---|
| 446239 | 1/1948 | Canada | 222/102 |

*Primary Examiner*—Philippe Derakshani
*Attorney, Agent, or Firm*—Kenyon & Kenyon

[57] ABSTRACT

A wall mounted inner housing in which a pair squeeze rollers are mounted in fixed side wall bearings. The front roller shaft can be selectively engaged by the outer housing, a three sided closure that hinges on the roller's shaft, where it serves two functions. Following a succession of direct finger squeezing/ dispensing actions the squeeze rollers are rotated, pulling the tube upwards, thereby compressing the tube, scavenging, consolidating and reconstituting the finger indented tube. The closure is then disengaged from the roller shaft wherein it again functions as a closure. A wall mounted device includes a two part housing, a pair of squeeze rolls set in fixed side wall bearings of inner housing. The outer housing, a three sided enclosure hinges on shaft of front roller, to which it can be locked, so as to rotate the squeeze rolls. An inverted collapsible tube is supported by the squeeze rolls its contents being dispensed by direct finger squeezing the neck of the tube. Periodically the closure is used to rotate the squeeze rolls thereby consolidating the remains and reconstituting the finger indented tube.

16 Claims, 5 Drawing Sheets

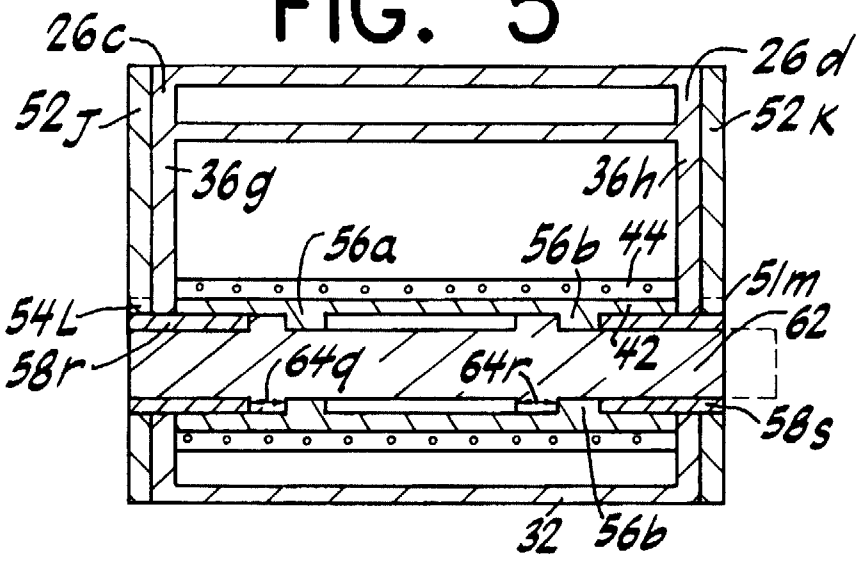
FIG. 5
FIG. 6
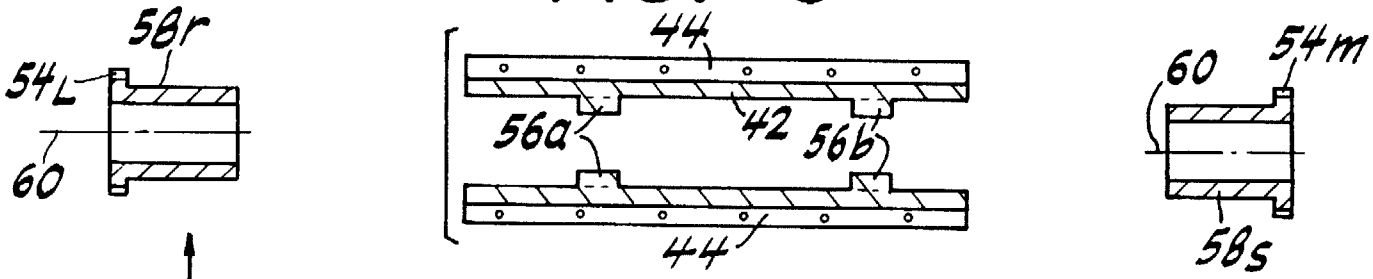
FIG. 7

COLLAPSIBLE TUBE DISPENSER AID

BACKGROUND OF THE INVENTION

1. Field of the Invention

The present invention is in the general field of mechanical collapsible tube dispenser devices, but relates specifically to dispensers which combine direct finger squeezing of a freely hanging tube, as the manner of dispensing the tube's contents, with periodic mechanical restoration of the partially collapsed tube to a fully restored, finger-indent free state.

2. Description of the Related Art

The object of most of the prior art mechanical dispensers was to replace, by mechanical mechanisms, all the functions the human hand performed in dispensing product from a collapsible tube. This included scavenging and consolidating the remaining contents until all the contents had been removed from the tube. This early and widely-held approach is shown in U.S. Pat. No. 1,975,915, issued in 1934 to J. E. Bannister, and later in U.S. Pat. No. 3,501,054, issued in 1970 to R. E. Maurice (see p. 1, col. 1, lines 35–37). Generally, the wall-mounted collapsible tube dispensers of the prior art show devices with complicated mechanical designs that are difficult to use, costly to manufacture and lacked visual appeal. U.S. Pat. No. 4,607,763,issued to Carl A. Wright in 1986, is an example of the structural and mechanical complexity of many of the prior art mechanical dispensers.

SUMMARY OF THE INVENTION

The object of the present invention is a to provide a dispenser aid, in the form of a wall-mounted elongated box-like structure, into whose tube holding/squeezing mechanism the flat sealed end of a collapsible tube can be inserted almost instantly and thereafter hangs freely. A further object is that the tube's contents are dispensed by gently squeezing the neck of the tube with the fingers of either hand. A further object is that following a succession of finger dispensing actions, the tube holding/squeezing mechanism, a pair of squeeze rollers, can be rotated in place, an action that simultaneously consolidates the remaining contents and fully reconstitutes the finger-indented tube. A further object of the present invention is that the emptied tube can be easily removed, in one motion, by grasping the tube's nozzle and pulling it straight down. A further object is that the squeeze rollers' shafts are set in upper side wall bearings of the inner structure wherein the three-sided closure hinges on the extended shaft of the front roller and can be locked onto the shaft of the front roller, thereby making it the mechanism for rotating the pair of squeeze rollers synchronously. A still further object of the present invention is that the entire dispenser aid is molded of appropriate plastic, at a low cost, making the dispenser aid rust proof and visually appealing. A further advantage of the present invention is that nothing has to be removed, reset, or cleaned before loading or unloading a tube or during its daily use. In the future, collapsible tubes 50% larger can be offered to the public, at greatly reduced costs, as well as liquid products now packaged in expensive plastic bottles. Shampoos in paste form would be more easily handled and safer to use in a shower stall with the present invention.

BRIEF DESCRIPTION OF THE DRAWINGS

FIG. 5 is a top cross-sectional view, through line V—V of FIG. 2, of the front roller and the geared slidable engagement mechanism which locks the closure to the front roller shaft;

FIG. 6 is a cross-sectional view of the hollow front roller shaft showing its two internal gears;

FIG. 7 is a cross-sectional view of the left and right rotatable shaft and closure support inserts;

DETAILED DESCRIPTION OF THE INVENTION

Figure 1:
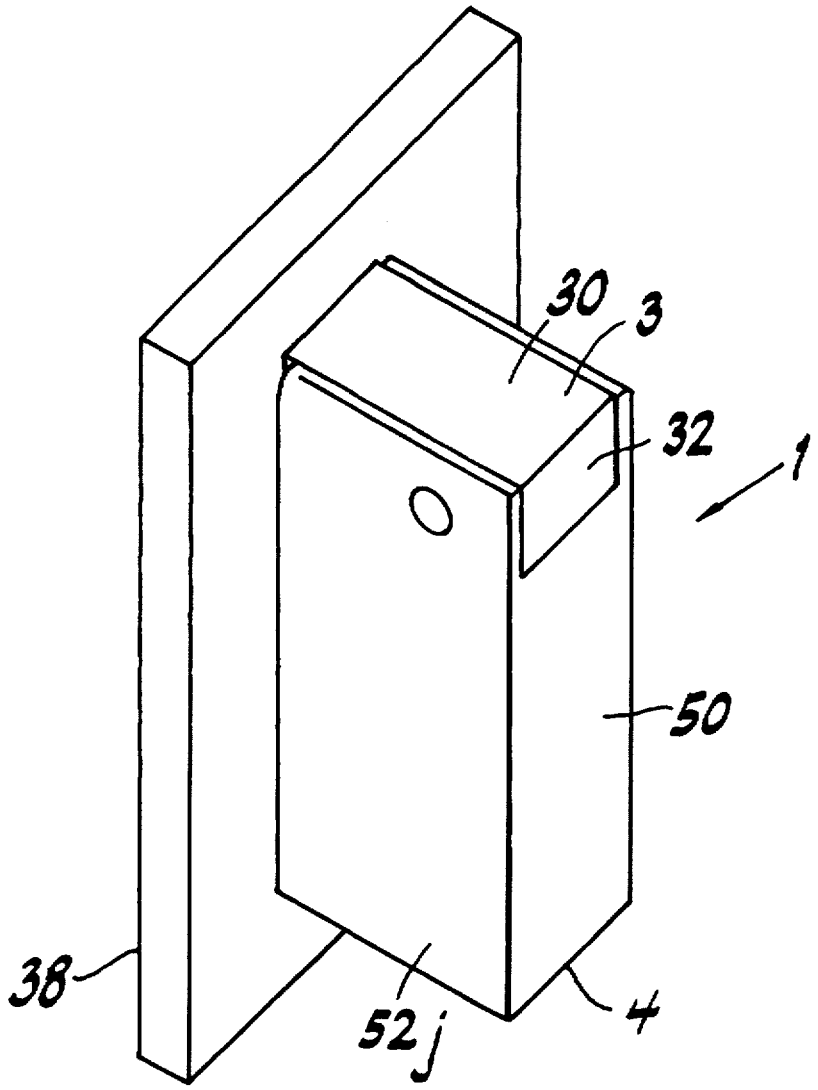
FIG. 1 is a perspective view of the present invention.

FIG. 1 is a perspective view of the present invention, a dispenser aid 1 mounted on a supporting wall 38.

Figure 2:
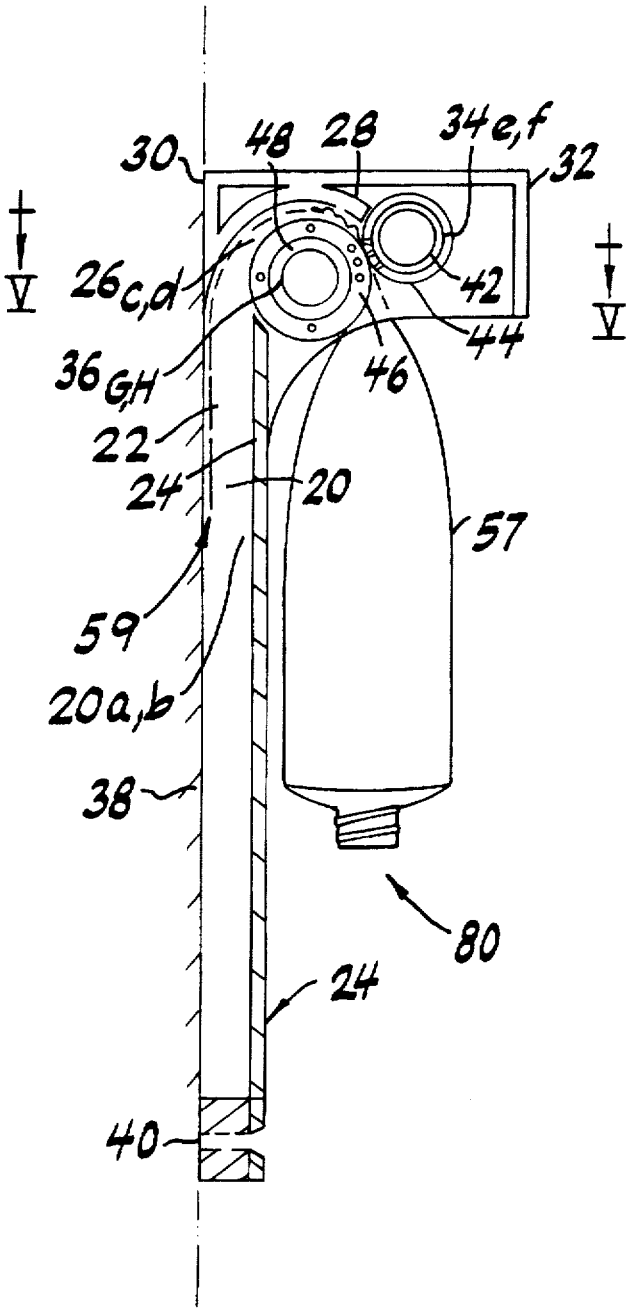
FIG. 2 is a side elevational view of the wall mounted structure of the present invention showing a partially-emptied collapsible tube suspended by the set of squeeze rollers, and the flattened empty portion of the collapsible tube inside the storage barrier chamber.
Figure 2A:
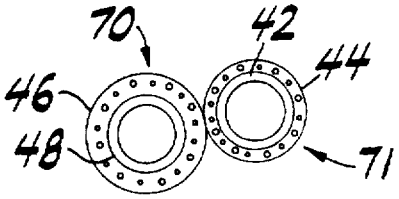
FIG. 2*a* is a detail view of the rollers of the present invention.

FIG. 2 is a vertical side elevational view of the inner support structure 3 of the dispenser aid 1. The narrow vertical side walls 20*a*, 20*b* of the inner support structure 3 are expanded and extended at the upper end to form two side walls 26*c*, 26*d*. A flat roof 30 with attached inner curved guide 28 and a front panel 32 are joined to the two side walls 26*c*, 26*d*. Each of the two side walls 26*c*, 26*d* have front bearings 34*e*, 34*f* and rear bearings 36*g*, 36*h*. A space 22, the storage-barrier chamber, is formed between the supporting wall 38 and the structural panel 24 that separates and holds the two vertical sides 20*a*, 20*b* of the inner support structure 3. Two squeeze or compression hollow rollers 70, 71, with hollow shafts 48, 42 and resilient high-friction polymeric covers 44, 46, are mounted in the side bearings 34*e*, 34*f* and 36*g*, 36*h*. Wall mounting spacers 40 may be attached to or molded into structural panel 24 for mounting dispenser aid 1, via screws, glue, or any other known securement mechanism, to a support wall 38. As shown in FIG. 2, the collapsible tube 57 may be held between the rollers 70, 71, such that the flattened empty end 59 of tube 57 projects into space 22. The rollers 70, 71 can be covered with a high friction, yielding (40–80 durometer hardness) tough synthetic polymeric material such as foam rubber, or any equivalent material. As a result, the two rollers 70, 71 can be located at fixed positions in sides 20*a*, 20*b*, in contact with one another and under slight pressure without the tube placed between the two rollers. Furthermore, when the tube 57 is between the two rollers the outer material yields to thereby retain contact with both sides of the tube 57 and provide friction and pressure to grip the tube 57 and allow the tube 57 to be advanced upward. As a result, the high friction, yielding material makes unnecessary the need for springs or slots to ensure constant contact between the rollers 70, 71 when the tube 57 is not inserted between the rollers 70, 71, and between the rollers 70, 71 and the tube 57 when the tube 57 is inserted between the rollers 70, 71. All parts of the housing can be made of an appropriate plastic material, and may be preferably made of transparent plastic for easy viewing of tube 57.

Figure 3:
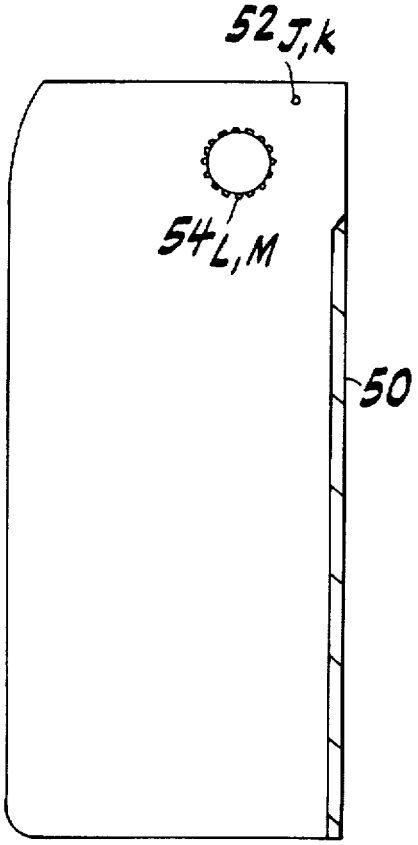
FIG. 3 is a side elevational view of the three sided closure of the present invention.

FIG. 3 is a side elevational view of the three-sided closure 4. The two side panels 52*j*, 52*k* are joined to the foreshortened front panel 50. Each side panel 52*j*, 52*k* has an internal geared hinge bearing 541, 54*m*. As is described below, the closure 4 is pivotally or rotatably mounted to the inner support structure 3.

Figure 4:
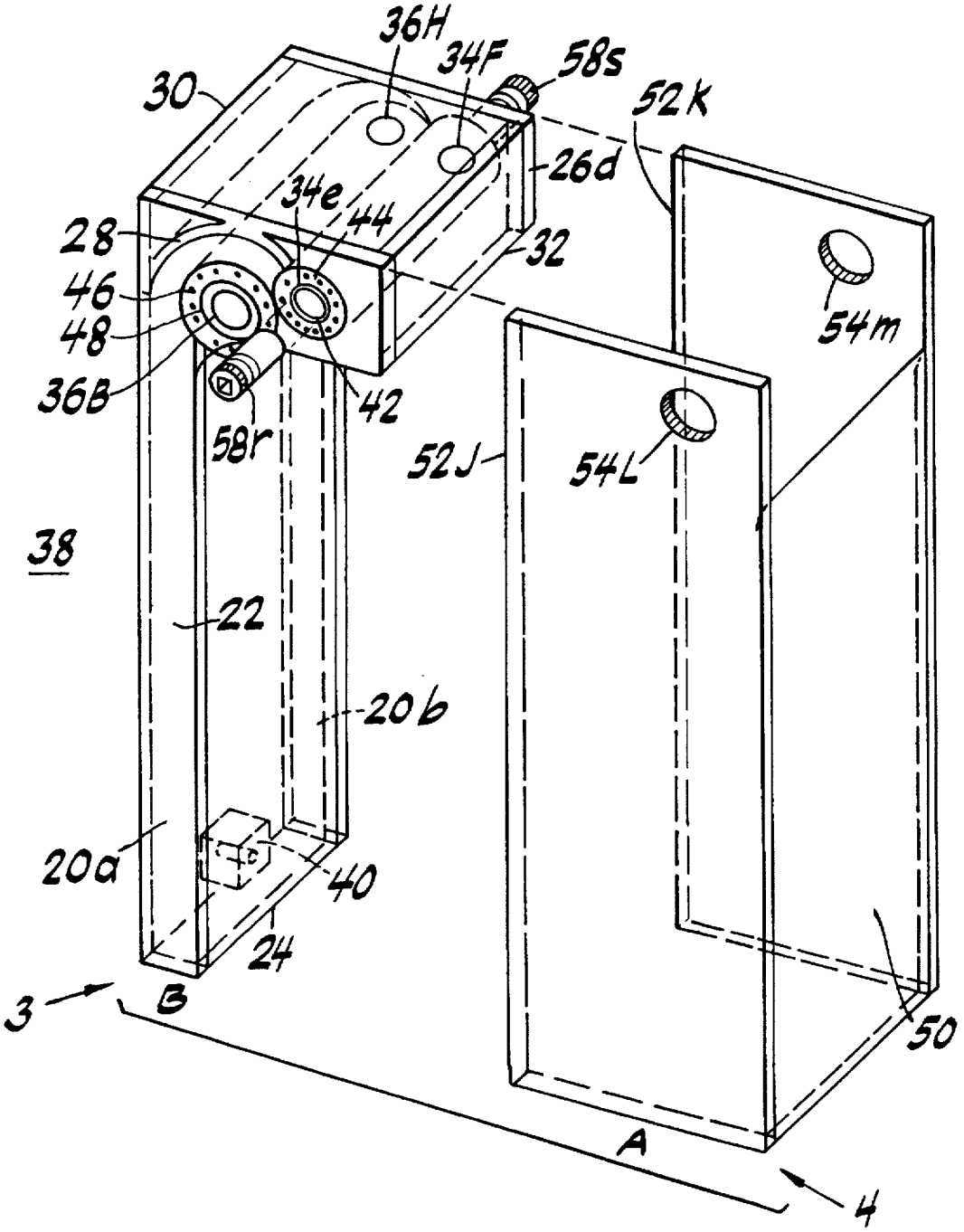
FIG. 4 is an exploded perspective of the present invention.

FIG. 4 shows an exploded perspective view of the inner wall mounted support structure 3 on the left (labeled with the letter B) and the three-sided front closure 4 on the right (labeled with the letter A). The spur-geared support bearings 58*r*, 58*s* are shown in FIG. 4 removed from their normal location for ease of viewing.

FIG. 5 shows a horizontal cross-sectional plan view of the housing in the fully closed mode, through the line V—V of FIG. 2. The front squeeze roll 71 includes a hollow shaft 42 having two internal gears 56*a*, 56*b*. A resilient, high-friction polymeric material 44 encloses the entire outer surface of hollow shaft 42. The spur-geared support bearings 58*r*, 58*s* have a square-shaped center 60. Side panels 52*j*, 52*k* include geared hinge bearings 541, 54*m* which interact with gears 541, 54*m* on spur-geared support bearings 58*r*, 58*s* to thereby rotate support bearings 58*r*, 58*s* upon rotation of closure structure 4. Slidable shaft 62 includes two spur gears 64*q*, 64*r* with selectively interact with internal gears 56*a*, 56*b* upon sliding of shaft 62. In FIG. 5, the gears 56*a*, 56*b*, 64*q*, 64*r* are shown in a disengaged state, and the dashed-line representation shows the position of the shaft 62 which results in engagement of the gears 56*a*, 56*b*, 64*q*, 64*r*. Engagement of the gears 56*a*, 56*b*, 64*q*, 64*r* causes the front roller 71 to rotate in conjunction with movement of closure structure 4, through the engagement between the square shaft 62 and the square-shaped center 60 of support bearings 58*r*, 58*s*.

FIG. 6 shows a horizontal cross-sectional view of the front squeeze roll 71, the two internal gears 56*a*, 56*b*, the high friction polymeric material 44 and the hollow cylindrical shaft 42.

FIG. 7 is a vertical cross-sectional view of the cylindrical support bearings 58*r*, 58*s* with spur gears 541, 54*m* located on one end of the bearing. The center of the bearing 60 is square shaped, and interacts with the square shaped shaft 62 to cause mutual rotation of the shaft 62 upon rotation of bearings 58*r*, 58*s*.

Figure 8:
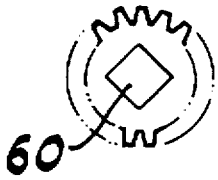
FIG. 8 is an end view of the inserts shown in FIG. 6.

FIG. 8 is an elevational end view of FIG. 7 showing the square shaped center 60 and the spur gear 541, 54*m*.

Figure 9:
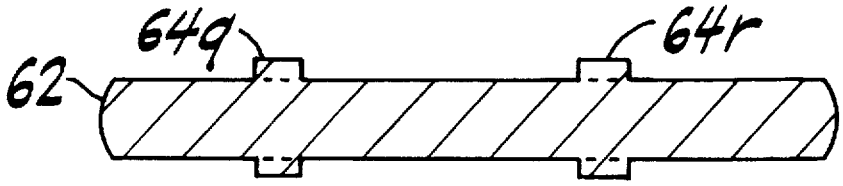
FIG. 9 is a side elevational view of the slidable shaft which transmits the rotational movement of the closure to the front roller.

FIG. 9 is a vertical cross-sectional view of the double-geared 64*q*, 64*r* slidable shaft 62.

Figure 10:
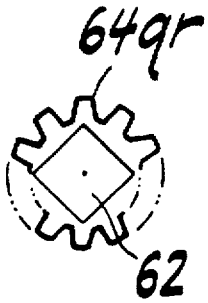
FIG. 10 is a cross-section elevational view of FIG. 9 showing the square shape of the slidable shaft and the two gears mounted thereon.

FIG. 10 is a cross-sectional elevational view of FIG. 9 showing the square shaped slidable shaft 62 with spur gears 64*q*, 64*r*.

Operation of the present invention is as follows. Loading a new tube 57 in the dispenser aid 1 requires that the flat sealed end 59 of the tube 57 be passed through the compression zone between the two squeeze rollers 70, 71. This action requires locking the three-sided front closure, in its full open or up position, onto the front roller 71. Locking is accomplished by sliding shaft 62 to the dotted line position of FIG. 5, so that spur gears 64*q*, 64*r* on shaft 62 engage internal gears 56*a*, 56*b* on hollow shaft 42. This engagement allows rotation of front closure to rotate roller 71, and by engagement of roller 71 with roller 70 through tube 57, rotates roller 70 as well. Slowly rotating front roller 71 towards the tube 57 therefore causes rollers 70, 71 to pull tube 57 upwardly, between the rollers 70, 71. During loading, the flat sealed end 59 of the tube 57 is gently pushed upwards between the rotating rollers 70, 71 by hand while the front closure is rotated downwardly. Under these conditions, the sealed flat end 59 of the tube 57 will be instantly pulled through the compression zone between the squeeze rollers 70, 71. The front closure is then disengaged from the front roller 71. Disengagement is accomplished by sliding shaft 62 so that spur gears 64*q*, 64*r* on shaft 62 disengage from internal gears 56*a*, 56*b* on hollow shaft 42—i.e, are in the position shown in FIG. 5. The front closure is then rotated upwards to its full open position. The tube 57 is now securely held in an inverted, freely hanging mode ready for finger dispensing of its contents.

After removing the cap from the tube 's nozzle 80 the fingers grasp and pull the neck of the tube forward, away from the structural panel 24 of the inner housing to more conveniently dispense the contents. A gentle squeeze of the neck of the tube 57 by the fingers will force the desired amount of the contents out of the tube 57. Following a succession of finger dispensing actions, it becomes necessary to consolidate the remaining contents and reconstitute the partially collapsed tube 57. The cap is replaced after each dispensing action.

After the tube 57 is capped, the front closure, in the full open position, is locked onto the front roller 71, in the manner described above. The closure is gently rotated downward, causing the tube 57 to be drawn upwards between the squeeze rollers 70, 71. As the tube 57 passes through the squeeze rollers 70, 71, the contents of the tube 57 are consolidated into an ever-decreasing volume of the tube 57 until a point is reached when further rotation of the squeeze rollers 70, 71 raises the internal pressure within the tube 57. As the internal pressure rises all the previous finger indents in the tube 57 are removed, bringing the tube 57 back to its original state wherein finger dispensing may be continued. Finger dispensing and reconstitution of the tube alternate until the tube is cleared of its contents, and the tube 57 may then be removed.

To remove the tube 57, the fingers grasp the recapped nozzle 80 and pull the tube 57 down and out of the compression zone between the squeeze rolls 70, 71.

It is to be understood that many variations are possible under the teachings of the present disclosure. For example, the mechanism for locking and unlocking the closure to the rollers could be made external to the closure, and need not be contained internally within one of the rollers. Additionally, a mechanism could be provided for automatically locking and unlocking the closure to the roller at the top and the bottom of the range of movement of the closure—i.e., a ratcheting mechanism could be used between the closure and the front roller. Also, the front closure need not rotate to move the rollers, and could move in any other appropriate fashion—i.e., it could reciprocate from an upper to a lower position. The present invention is not limited by the particular structures and methods described above, but is instead defined by the claims below.

I claim:

1. An apparatus for aiding dispensing of material from a collapsible container, said apparatus comprising:

a support structure;

a closure structure movable relative to said support structure, said closure structure and said support structure together defining a hollow space for housing said collapsible container;

at least one roller, said at least one roller being engageable with an end of said container, said at least one roller being rotatable in a direction away from said hollow space to thereby move said end of said container away from said hollow space, said at least one roller being selectively engageable with said closure structure such that movement of said closure structure in a first direction causes said at least one roller to rotate in said direction away from said hollow space to thereby move said end of said container away from said hollow space, and such that movement of said closure structure in a second direction opposite to said first direction, upon disengagement of said at least one roller from said closure structure, does not cause movement of said at least one roller.

2. The apparatus of claim 1, further comprising:

a second roller, said second roller being engageable with said end of said container, movement of said at least one roller in a direction away from said hollow space causing movement of said second roller in a direction away from said hollow space, to thereby move said end of said container away from said hollow space.

3. The apparatus of claim 1, wherein:

said closure structure is rotatably mounted on said support structure.

4. The apparatus of claim 1, wherein:

said support structure comprises a storage space, said end of said container passing into said storage space after movement past said at least one roller.

5. The apparatus of claim 4, wherein:

said support structure comprises an arched portion, said arched portion being located between said at least one roller and said storage space.

6. The apparatus of claim 1, wherein:

said support structure comprises an attachment mechanism for attaching said support structure to a surface.

7. The apparatus of claim 1, wherein:

said at least one roller comprises:

(a) a hollow shaft, said hollow shaft comprising gears on an inner surface;

(b) a second shaft, said second shaft being movable relative to said hollow shaft, said movable shaft comprising gears on an outer surface, said gears on said hollow shaft being selectively engageable with said gears on said second shaft;

and said closure structure is pivotally mounted on said support structure, said closure structure comprising a bearing fixedly secured to said closure, said bearing being engageable with said second shaft to rotate said second shaft upon rotation of said closure.

8. The apparatus of claim 7, further comprising:

a second roller, said second roller being engageable with said end of said container, movement of said at least one roller in a direction away from said hollow space causing movement of said second roller in a direction away from said hollow space, to thereby move said end of said container away from said hollow space.

9. The apparatus of claim 1, wherein:

said at least one roller comprises a resilient, high-friction polymeric material on its outer surface.

10. The apparatus of claim 2, wherein:

said at least one roller comprises a resilient, high-friction polymeric material on its outer surface, and said second roller comprises a resilient, high-friction polymeric material on its outer surface.

11. An apparatus for aiding dispensing of material from a collapsible tube, said apparatus comprising:

a support structure, said support structure being securable to a vertical surface;

a closure structure rotatably mounted on said support structure, said closure structure and said support structure together defining a hollow space for housing said collapsible tube;

a first roller, said first roller being engageable with an end of said collapsible tube, said first roller comprising:

(a) a hollow shaft, said hollow shaft comprising gears on an inner surface, said hollow shaft being engageable with an end of said collapsible tube;

(b) a second shaft, said second shaft being movable relative to said hollow shaft, said movable shaft comprising gears on an outer surface, said gears on said hollow shaft being selectively engageable with said gears on said second shaft;

said closure structure further comprising a bearing fixedly secured to said closure structure, said bearing being engageable with said second shaft to rotate said second shaft upon rotation of said closure structure, whereby movement of said closure structure in a first direction causes said first roller to move in a direction away from said hollow space to thereby move said end of said container away from said hollow space, and whereby movement of said closure structure in a second direction opposite to said first direction, upon disengagement of said at least one roller from said closure structure, does not cause movement of said at least one roller; and a second roller, said second roller being engageable with said end of said container, movement of said first roller in a direction away from said hollow space causing movement of said second roller in a direction away from said hollow space, to thereby move said end of said container away from said hollow space.

12. A method of dispensing material from a collapsible container having a dispensing opening and a closure cap comprising the steps of:

providing a support structure on a vertical surface, said support structure having two rollers closely adjacent one another;

inserting an end of said collapsible container between said two rollers;

rotating at least one of said rollers to thereby scavenge and consolidate said material toward an end of said collapsible container containing said dispensing opening and raise said collapsible container;

removing said closure cap from said dispensing opening;

drawing said end of said collapsible container containing said dispensing opening away from said vertical surface;

dispensing said material from said dispensing opening of said collapsible container by finger depressing side surfaces of said collapsible container;

replacing said closure cap on said dispensing opening; and rotating said at least one of said rollers to thereby scavenge and consolidate said material toward said end of said collapsible container containing said dispensing opening, wherein said steps of rotating at least one of said rollers comprise the steps of engaging a closure structure of said support structure with said at least one of said rollers and rotating said support structure to thereby rotate said at least one of said rollers.

13. The method of claim 12, further comprising the step of:

opening said closure structure to provide access to said collapsible container prior to said step of dispensing said material from said dispensing opening.

14. The method of claim 12, wherein:

said step of opening said closure structure comprises disengaging said closure structure from said at least one of said rollers.

15. An apparatus for aiding dispensing of material from a collapsible container, said apparatus comprising:

a support structure;

a closure structure movable relative to said support structure, said closure structure and said support structure together defining a hollow space for housing said collapsible container;

at least one roller, said at least one roller being engageable with an end of said container, said at least one roller being rotatable in a direction away from said hollow space to thereby move said end of said container away from said hollow space; and a storage space, said storage space receiving said end of said container after said end of said container has moved past said at least one roller and out of said hollow space.

16. The apparatus of claim 15 further comprising:

a curved guide located between said hollow space and said storage space, said curved guide guiding said end of said container from said hollow space to said storage space.

* * * * *

UNITED STATES PATENT AND TRADEMARK OFFICE

CERTIFICATE OF CORRECTION

PATENT NO. : 5,775,540

DATED : July 7, 1998

INVENTOR(S) : Greenberg

It is certified that error appears in the above-identified patent and that said Letters Patent is hereby corrected as shown below:

Title page, item [57], Abstract: change "a pair squeeze rollers" to --a pair of squeeze rollers--;

Column 1, line 32, change "is a to provide" to --is to provide--;

Column 3, line 7, change "54l" to --54*l*--;

Column 3, line 18, change "roll" to --roller--;

Column 3, line 24, change "54l" to --54*l*--;

Column 3, line 25, change "54l" to --54*l*--;

Column 3, line 28,change "with" to --which--;

Column 3, line 38, change "roll" to --roller--;

Column 3, line 43, change "54l" to --54*l*--;

Column 3, line 49, change "54l" to --54*l*--;

Column 4, line 42, change "rolls" to --rollers--;

Signed and Sealed this

Twenty-seventh Day of June, 2000

*Attest:*

*Attesting Officer*

Q. TODD DICKINSON

*Director of Patents and Trademarks*